United States Patent [19]

MacKay, Jr. et al.

[11] 3,990,124

[45] Nov. 9, 1976

[54] REPLACEABLE BUFFING PAD ASSEMBLY

[76] Inventors: Joseph H. MacKay, Jr., 20 Vanech Drive, Stamford, Conn. 09604; Jack M. Haigh, 14 Overlook Place, Rye, N.Y. 10580

[22] Filed: Dec. 3, 1974

[21] Appl. No.: 529,196

Related U.S. Application Data

[63] Continuation-in-part of Ser. No. 383,003, July 26, 1973, abandoned.

[52] U.S. Cl. ..... 15/230.12; 15/230.15; 15/230.19; 51/378

[51] Int. Cl.[2] ..... B24D 13/14; B24D 13/20

[58] Field of Search ..... 15/230, 230.1, 230.12, 15/230.14, 230.15, 230.16, 230.17, 230.18, 230.19; 51/376–379, 400, 404, 358

[56] References Cited

UNITED STATES PATENTS

| | | | |
|---|---|---|---|
| 351,737 | 11/1886 | Buzzell | 51/378 |
| 1,640,032 | 8/1927 | Fiechter | 15/230.18 |
| 1,779,682 | 10/1930 | Stratford | 51/379 |
| 1,819,800 | 8/1931 | Turner | 15/230.19 |
| 1,998,244 | 4/1935 | Lang | 15/230 |
| 3,141,185 | 7/1964 | Terzian | 15/230 X |
| 3,413,674 | 12/1968 | Reid | 15/230.12 |
| 3,717,894 | 2/1973 | Wakefield | 15/230.15 X |

FOREIGN PATENTS OR APPLICATIONS

| | | | |
|---|---|---|---|
| 129,364 | 2/1947 | Australia | 51/358 |
| 727,595 | 4/1955 | United Kingdom | 51/401 |

*Primary Examiner*—Daniel Blum
*Attorney, Agent, or Firm*—Nilsson, Robbins, Dalgarn & Berliner

[57] ABSTRACT

A replaceable buffing pad assembly including a hard surfaced, nonresilient, central support disc having first and second surfaces and defining a central opening therethrough. Drive means is disposed at the central opening for receiving a power tool to rotate the buffing pad. First and second layers of buffing material are secured on said first and second surfaces respectively. The layers of buffing material extend from the central opening on the support disc for a distance greater than the outer periphery of the support disc. The outer edges of the buffing material are secured to each other to form a continuous surface of buffing material.

10 Claims, 7 Drawing Figures

FIG.3.
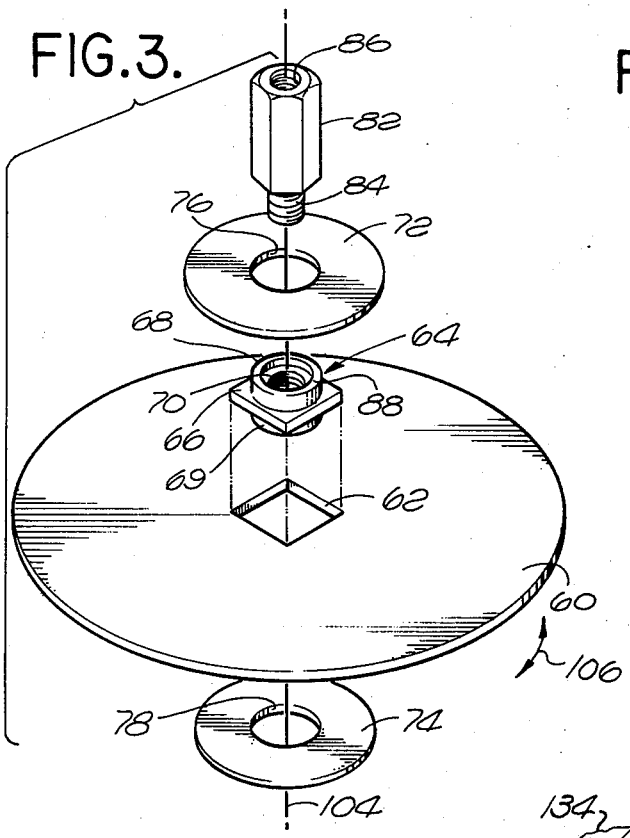
FIG.6.
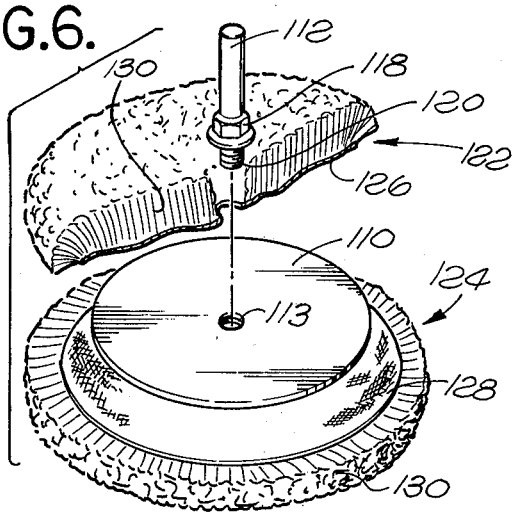
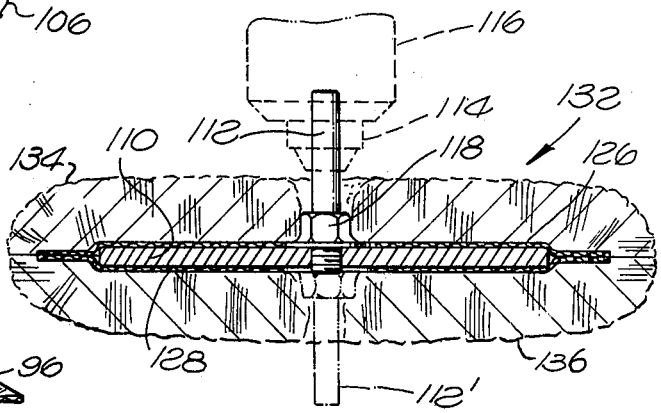
FIG. 7.
FIG.4.
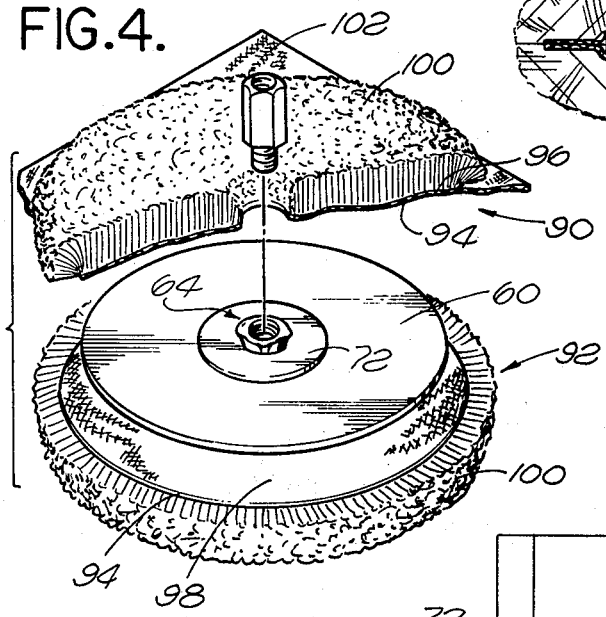
FIG.5.
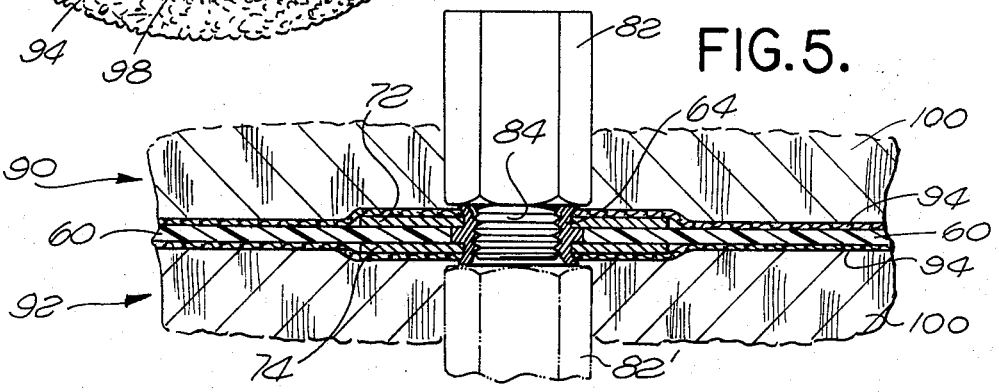

REPLACEABLE BUFFING PAD ASSEMBLY

REFERENCE TO OTHER APPLICATIONS

The present invention is a Continuation-In-Part of U.S. Patent application Ser. No. 383,003 filed July 26, 1973 entitled REPLACEABLE BUFFING PAD ASSEMBLY (now abandoned).

BACKGROUND OF THE INVENTION

1. Field of Art

The field of art to which the invention pertains includes the field of buffing pad assemblies, particularly with respect to a pad assembly forming a continuous surface of buffing material.

2. Description of the Prior Art

Conventional buffing pad structures are used in conjunction with a back-up or support pad that typically is made of rubber, fiber or plastic and is affixed to a power tool. The buffing pad is then affixed to the support pad with a tie string as in the case of a lambskin bonnet, or can be held by a retainer nut which is threadably attached to the spindle of the power tool. In most commercial applications, it is desirable that the buffing pad-support pad assembly be flexible for the purpose of more closely following the contours of the surface to be polished. However, the flexing of the assembly frequently results in burning the surface because of the increased pressure at the edge. For the purpose of minimizing the risk of burning, buffing structures frequently contain rounded edges or extremely soft support pads. However, this type of structure is more costly to produce than a flat structure and has the effect of making the edge portion of the buffing material unavailable for use.

Known prior art includes U.S. Pat. Nos. 3,418,675; 3,413,674; 351,737; 2,469,429; 1,779,682; 1,687,071; 2,227,588; 2,644,280, and British Pat. No. 727,595, published Apr. 6, 1955.

The present invention provides a soft edge surface buffing pad when the pad is flexed in any direction. The pad structure is such that burning of the work surface by the buffing pad is eliminated. The entire buffing pad assembly is relatively inexpensive and can be discarded when used. A variety of support disc arrangements can be provided for particular applications.

SUMMARY OF THE INVENTION

A replaceable buffing pad assembly comprising a hard surfaced, non-resiliently deformable support disc defining a central opening therethrough and having first and second sides. First and second buffing layers each including a base layer and tufted buffing material are permanently secured to the first and second sides of the support disc. The buffing layers each define a central aperture aligned with the opening in the support disc and the layers extend beyond the periphery of the support disc.

BRIEF DESCRIPTION OF THE DRAWINGS

FIG. 3 is an exploded view illustrating the support disc utilized with an alternative embodiment of a buffing pad constructed in accordance with the present invention;

FIG. 4 is a partially exploded view of a buffing pad in accordance with the present invention, partially constructed, utilizing a suppot disc as shown in FIG. 3;

FIG. 5 is a fragmentary view taken in cross-section illustrating the alternative embodiment utilizing a support disc shown in FIG. 3;

FIG. 6 is an exploded view of another alternative embodiment of a buffing pad constructed in accordance with the principles of the present invention; and FIG. 7 is a cross-sectional view of a fully assembled buffing pad of the type illutrated in FIG. 6.

DESCRIPTION OF THE PREFERRED EMBODIMENTS

Figure 1:
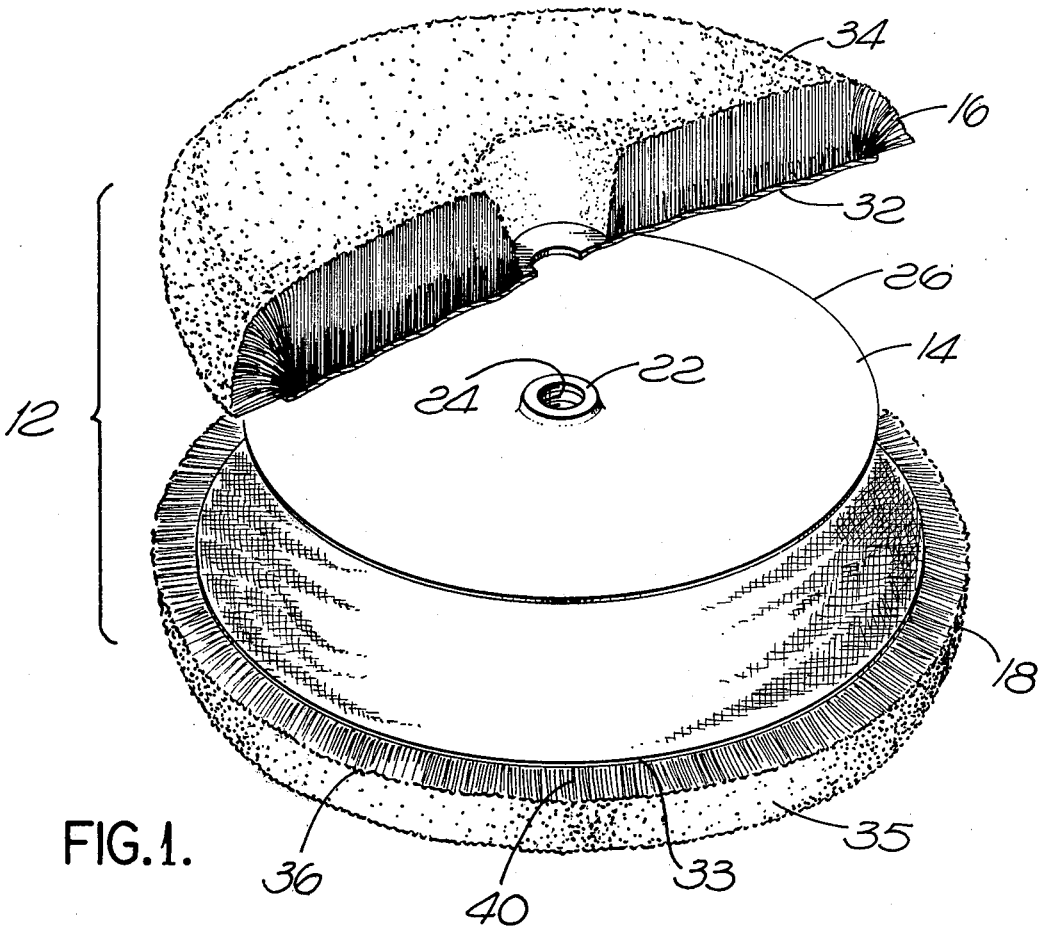
FIG. 1 is an exploded perspective view, partially broken away, of a replaceable buffing pad assembly in accordance with one embodiment of the present invention.

Referring now to FIG. 1, there is shown a buffing pad assembly 12 made in accordance with principles of the present invention. The assembly is normally formed so that it can be secured to a power tool at the center thereof and used to polish a finished surface, such as a surface of an automobile. Such a process normally involves the application of a cleaning compound to the suface to be polished and the buffing of the cleaning compound onto the surface with the buffing pad assembly 12 to create a sheen.

The buffing pad assembly is shown in FIG. 1 in an exploded perspective view prior to assembly. The buffing pad assembly 12 comprises a central support disc 14 of hard surfaced, non-resilient material which is sandwiched between a first buffing layer 16 and a second buffing layer 18. The disc 14 contains a central hub 22 having a threaded opening 24 which extends therethrough and typically can be used to secure a drive shaft (not shown) therein for rotating the buffing pad assembly.

As can be seen more clearly in the cross-sectional view of the assembled buffing pad assembly of FIG. 1, the disc 14 tapers from a first thickness adjacent the hub 22 to its outer peripheral edge 26. The disc 14 is normally made of a plastic molded material such as Nylon or other similar type materials.

The buffing layers 16 and 18 are normally identical and are constructed of a base layer of canvas, duck, burlap or similar material 32 and 33, respectively. Material 34 and 35 such as wool, Nylon or other suitable fibers may be secured to the layer of base material 32 and 33, respectively, by tufting, knitting or other techniques well known in the textile industry. These and other materials could also be adhesively secured to the inner layers of base material. Processed lamb or sheep skin with the wool sheared to proper length or suitable homogenous resilient materials can also be used for the buffing layers 16 and 18.

Figure 2:
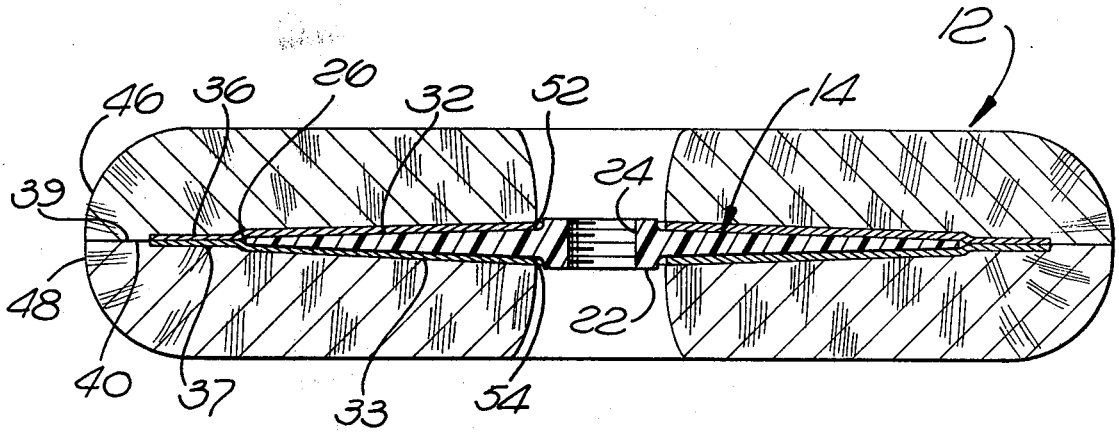
FIG. 2 is a cross-sectional view of an assembled buffing pad assembly as shown in FIG. 1.

The base material 32 and 33 of the buffing pads 16 and 18 extends beyond the peripheral edge 26 of the disc 14. As can be seen in FIG. 2 the overlapping edges 36 and 37, of the base material 32 and 33, respectively, which extend beyond the peripheral edge 26 of the disc 14 are glued and/or stitched together. In addition, the surface of the base material 32 and 33, adjacent the disc 14, surfaces are glued thereon so as to form a sandwich like structure. The tufted material 34 and 35, whose outer edge fibers 39 and 40, extend from their overlapping edges 36 and 37, form a continuous suface at their outer edge sufaces 46 and 48, respectively.

The buffing layers 16 and 18 each have a central opening 52 and 54, formed in the base material 32 and 33, respectively, enabling the layers to be secured to the disc 14 while simultaneously enabling a drive shaft (not shown) to extend into the threaded opening 24 of the disc 14 from either side.

In a commercial configuration for use such as in polishing automobiles, the disc 14 is approximately 7 inches in overall diameter, and the base material 32 and 33 each have an 8 inch diameter so that one-half inch diameter overlapping edges 36 and 37 are formed adjacent the peripheral edge 26 of the disc 14 where the base material is secured together. The structure provides sufficient flexibility at the outer edge fibers 39 and 40 of the buffing pads when a force is exerted in any direction, and therefore, overcomes the prior art tendency of buffing pads to burn the paint with the pad edge. The construction permits the soft edge to maintain appropriate radial integrity so that the buffing pad can be driven properly by the drive shaft.

While the buffing layers 16 and 18 are described as having identical tufted material 34 and 35, respectively thereon, different types of material could be used on each of the buffing layers so that the buffing pad assembly can be removed and then rotated 180° and replaced on the drive shaft, or can be simultaneously used by mere movement of the tool during the buffing. In addition, while the invention has been described as adhesively securing the buffing layers 16 and 18 to the disc 14, other methods of attachment could be provided. For example, the two buffing layers 16 and 18 could be sewn on together around the disc 14, or snaps or Velcro could be used for securing the pads together. Also, the disc 14 could have holes therethrough into which adhesive or sewing could be placed.

By varying the diameter of the central disc 14 along with the length of the fibers on the buffing layers various degrees of softness can be obtained. Therefore, a more aggressive type pad can be utilized for compounding and a softer pad used for final polishing of the surface. While the disc 14 has been illustrated as being a circular disc, it should be understood that slots, arcs or radial configurations could be utilized to vary the degree of softness of the pad assembly. In any event, it will be recognized by those skilled in the art that the support disc is not only hard surfaced but has radial rigidity. That is, even though the disc is turned at relatively high speed, the periphery thereof will not "grow" from material moving outwardly through centrifugal force. Buffing pads of the commercial application type should also have some axial flexibility depending upon the specific use.

An alternative embodiment of the buffing pad of the present invention is illustrated in FIGS. 3 through 5 to which reference is now made. As is therein shown, the buffing pad includes a flat central support disc 60 defining an opening 62 centrally disposed therein. The opening 62, as illustrated, is of a square configuration but may have any geometric design desired which includes a pluralty of straight edges. A drive nut 64 includes a radially extending center flange 66 having a thickness substantially equal to that of the support disc 60. The flange 66 about its periphery conforms in configuration as to mate with the opening 62. Thus the straight edges on the flange 66 mate with the straight edges provided in the opening 62, thereby to transfer forces applied to the nut by a power tool (not shown) directly to the support disc 60.

A body portion 68 extends axially of the flange 66 and defines a centrally disposed threaded opening 70 as shown. Retaining washers 72 and 74 are disposed, one on each side of the support disc 60, in such a manner that the axially extending body portions 68–69 extend through openings 76 and 78 provided in the washers 72 and 74, respectively. The outer peripherial edge 80 of the body portions 68–69 are deformed as by upsetting or swagging or the like to retain the drive nut in place in the support disc 60.

There is provided a threaded stud 82 including a male extension 84 which mates with threads 70 defined by the drive nut 64. Also provided in the stud 82 is a reentrant bore 86 which is threaded and which is used to connect the buffing pad to a power tool (not shown).

First and second buffing layers 90 and 92 are affixed, one on each side of the support disc 60. The buffing layers each include a base material 94 having a first side 96 and a second side 98. Tufting material 100 is secured to each of said base material layers and extends outwardly from the first side thereof. The second sides of said base materials are permanently secured to opposite sides of said support disc, such as by adhesively securing the same thereto.

As is illustrated with respect to the layer of buffing material 90, the base material 94 may extend well beyond the tufting material 100 as is shown at 102. After the tufted buffing material 100 has been secured to the base layer 102, and the first and second buffing layers 90 and 92 have been secured in place upon the support disc 60, the extra peripherial material at 102 is trimmed as is illustrated in FIG. 4 so that the base material is coterminous with the tufted buffing material. Since it is secured to the base material, by such trimming, the tufted buffing material then extends beyond the base material when in operational form as is better illustrated in FIG. 2. As previously pointed out, the layer of base material also extends beyond the periphery of the support disc 60 and the second sides 98 of the base material 94 which extends beyond the periphery of disc 60 are secured to each other to maintain the integrity of the buffing pad.

The support disc 60 may be constructed of various types of material such as plastic, fiber, sheet metal and the like. In all instances, however, the support disc must be constructed of hard material having a hard surfaced, deformable material. Such a material provides a firm support for the buffing layer on each side thereof. In addition, the support disc 60 must have radial rigidity; that is, when turning at the relatively high speed utilized for buffing pads of this type, the support disc 60 should experience no growth as a result of the centrifugal forces applied thereto. When relatively large support discs 60 are utilized with relatively large buffing pads, such as seven inch and larger buffing pads utilized in the commercial market, the support disc 60 should have axial flexibility. That is, when considering an axis through the center portion of the device, such as is illustrated in FIG. 3 at 104, the support disc 60 should have the capability of bending in the direction of the arrow 106.

As is illustrated, more particularly in FIG. 5, the stud 82 may be positioned on one side of the buffing pad for a particular operation. Thereafter, the buffing pad may be reversed simply by removing the same from the stud 82 and replacing the buffing pad after reversal thereof upon the stud 82, such as illustrated by showing the stud 82 in dashed line on FIG. 5 at 82′.

It has also been determined that a double-sided, discardable buffing pad for home use may also be utilized in accordance with principles of the present invention. Such a device is illustrated in FIGS. 6 and 7 to which reference is now made. A support disc 110 defines a threaded central aperature 112 to which a driving member in the form of a threaded stud 112 may be affixed. The stud 112 is adapted to be received within the chuck 114 of a quarter inch drill 116 as may be found in most homes. A collar 118 is secured to the stud 112 above the threads 120 thereon to provide support with respect to the support disc 110. Perferably the support disc 110 is constructed of a hard surfaced, non-resiliently deformable material having radial rigidity, such for example, as a plate of aluminum or the like. The home use buffing pad, as illustrated in FIGS. 6 and 7, is of relatively small diameter when compared to its industrial counterpart, and as a result, axial flexibility in the support disc is not required. The needed axial flexibility for the buffing pad is provided by the extension of the buffing layers well beyond the periphery of the support disc.

As is the case with the other embodiments of the present invention, the first and second buffing layers, 122 and 124, each include a base layer 126 and 128, respectively, having opposite sides. Tufting material 130 extends outwardly from one side of each of the layers, 126 and 128, while the second sides thereof are permanently secured as by an adhesive material to opposite surfaces of the support disc 110 and extend beyond the periphery thereon. As before, those portions of the layers 126 and 128 which extend beyond the periphery of the support disc 110, are themselves secured to each other to maintain the integrity of the disposable buffing pad of the present invention.

It is contemplated that a home use buffing pad, constructed as illustrated in FIGS. 6 and 7, will be utilized, for example, by the car owner and then thrown away. The owner will use one side of the buffing pad, for example, 134 as shown in FIG. 7, to apply cleaning compound to the surface of the automobile. Subsequent to such application, the buffing pad 132, as shown in FIG. 7, will be unscrewed from the stud 112 and turned over so the opposite side 136 is exposed. Such is illustrated by the stud 112' shown in dashed configuration in FIG. 7. After such reversal, the surface 136 of the disposable home use buffing pad is utilized to polish the surface of the automobile and will then be discarded. If desired, of course, the pad may be cleaned and later reused.

Thus there has been disclosed various embodiments of the disposable buffing pad, having two sides, which may be utilized through the simple expedient of unscrewing the pad from the drive member, reversing it and then replacing the same upon the drive member by threading the same thereon. Both commercial and home use embodiments are illustrated and described.

What is claimed is:

1. A reversible soft edged buffing pad for use with a power driven tool comprising:

A. a support disc constructed of hard material having a hard surface, said support disc being the only support for said buffing pad, having radial rigidity and defining a central aperture therethrough;

B. attaching means integral with said support disc at said central aperture for receiving a power tool drive member for rotating said pad, said attaching means being the only means for securing said buffing pad to a power tool;

C. first and second buffing layers each including:

1. a layer of base material having first and second sides and defining a central aperture therethrough 2. tufted buffing material permanently secured to said base material and extending outwardly from said first side and to the periphery of said layer;

D. means permanently securing said second sides of said base material to opposite surfaces of said support disc, said base material and said tufted bufing material extending beyond the periphery of said support disc for a distance substantially less than the radius of said support member, said second sides of said base material being secured to each other co-extensive with the portion thereof extending beyond the periphery of said support disc; and E. said apertures in said base material being aligned with said aperture in said support disc, whereby said pad may be attached to a power tool from either side of said pad.

2. A buffing pad as defined in claim 1 wherein said support disc is axially flexible.

3. A buffing pad as defined in claim 2 wherein said attaching means includes reinforcing means.

4. A buffing pad as defined in claim 3 wherein said attaching means includes an integral unitary hub of increased thickness as compared to the body of said disc, the inner surface of said hub being threaded to receive said drive member.

5. A buffing pad as defined in claim 1 wherein said attaching means includes a threaded metallic insert permanently secured within said opening in said support disc.

6. A buffing pad as defined in claim 5 wherein said opening in said support disc and said metallic insert are of non-circular configuration.

7. A buffing pad as defined in claim 6 wherein said insert includes a threaded nut having a radially extending center member having a thickness substantially equal to that of said support disc and an axially extending body portion, first and second washers are disposed on each side of said center member and extending over the surface of said support disc to secure said nut in driving engagement with said suppot disc, said axially extending body portion being upset to retain said washers in place on said support disc.

8. A buffing pad as defined in claim 7 wherein said attaching means further includes a threaded stud having external threads for engagement with said threaded nut and a reentrant bore for receiving said drive member.

9. A buffing pad as defined in claim 1 wherein said support disc is a unitary metallic member defining a central threaded aperture therethrough.

10. A buffing pad as defined in claim 9 which further includes a threaded stud having a radially outwardly extending flange disposed adjacent the threads thereon for attachment to said central threaded aperture.

* * * * *

UNITED STATES PATENT OFFICE
CERTIFICATE OF CORRECTION

Patent No. 3,990,124 Dated November 9, 1976

Inventor(s) Joseph H. Mackay, Jr. et al.

It is certified that error appears in the above-identified patent and that said Letters Patent are hereby corrected as shown below:

Column 6, line 15, "bufing" should read -- buffing --.

Column 6, line 49, "suppot" should read -- support --.

Column 6, line 55, after "reentrant" insert -- threaded --.

Signed and Sealed this

Fifth Day of April 1977

[SEAL]

*Attest:*

RUTH C. MASON
*Attesting Officer*

C. MARSHALL DANN
*Commissioner of Patents and Trademarks*